US010531697B2

(12) United States Patent
Hussey

(10) Patent No.: US 10,531,697 B2
(45) Date of Patent: Jan. 14, 2020

(54) SEALING SLEEVE FOR WATERPROOF GARMENTS

(71) Applicant: Zhik Pty Ltd, Artarmon, New South Wales (AU)

(72) Inventor: Thomas Kenneth Hussey, Balmain (AU)

(73) Assignee: ZHIK PTY LTD, Artarmon (AU)

( * ) Notice: Subject to any disclaimer, the term of this patent is extended or adjusted under 35 U.S.C. 154(b) by 247 days.

(21) Appl. No.: 15/491,486

(22) Filed: Apr. 19, 2017

(65) Prior Publication Data

US 2017/0303611 A1 Oct. 26, 2017

(30) Foreign Application Priority Data

Apr. 21, 2016 (AU) ..... 2016901480

(51) Int. Cl.

| | |
|---|---|
| ***A41D 31/00*** | (2019.01) |
| ***A41D 13/012*** | (2006.01) |
| ***A41D 27/10*** | (2006.01) |
| ***A41D 27/24*** | (2006.01) |
| *B63C 11/04* | (2006.01) |

(52) U.S. Cl.

CPC ..... *A41D 31/00* (2013.01); *A41D 13/012* (2013.01); *A41D 27/10* (2013.01); *A41D 27/245* (2013.01); *A41D 2500/54* (2013.01); *B63C 2011/043* (2013.01)

(58) Field of Classification Search

CPC ..... A41D 31/00; A41D 31/06; A41D 31/065; A41D 31/102; A41D 27/10; A41D 27/245; A41D 2500/54; A41D 2300/30; A41D 2400/80; A41D 13/1227; A41D 2400/82; B63C 2011/043; B63C 11/04

USPC ..... 2/2.16, 2.17, 2.15; 428/332

See application file for complete search history.

(56) References Cited

U.S. PATENT DOCUMENTS

| | | | | |
|---|---|---|---|---|
| 4,438,531 | A * | 3/1984 | Long | A41D 13/012 2/2.15 |
| 4,946,453 | A * | 8/1990 | Monson | A41D 13/0017 2/2.15 |
| 5,924,130 | A * | 7/1999 | Fragomeli | A41D 13/08 2/16 |
| 6,415,449 | B2 * | 7/2002 | Duplock | A41D 13/012 2/275 |
| 6,530,090 | B1 * | 3/2003 | Ambrose | A41D 13/1209 2/125 |
| 6,576,337 | B1 | 6/2003 | Radford-Hancock | |
| 7,062,786 | B2 | 6/2006 | Stinton | |
| 7,155,746 | B2 * | 1/2007 | Schorr | A41D 13/1209 2/125 |

(Continued)

*Primary Examiner* — Alissa L Hoey

(74) *Attorney, Agent, or Firm* — Nixon & Vanderhye P.C.

(57) ABSTRACT

A waterproof garment is provided that includes a waterproof garment textile defining a garment opening, and a sealing sleeve joined at the garment opening. The sealing sleeve includes a substantially waterproof textile composite in the form of a tube extending between (i) a first end having a first opening and configured to fit tightly around a wearers body part and (ii) an opposing second end having a second opening and joined to the waterproof garment textile by a seam around the garment opening. The textile composite includes a stretchable textile with a substantially waterproof coating layer applied to the stretchable textile.

22 Claims, 7 Drawing Sheets

(56) References Cited

U.S. PATENT DOCUMENTS 7,302,711 B1 * 12/2007 Tanenbaum ..... A41D 19/0089 2/161.7
7,631,363 B2 * 12/2009 Myerscough ..... A41D 13/012 2/2.15
8,677,513 B2 * 3/2014 Mathis ..... A41D 19/0041 2/114
2002/0108160 A1 * 8/2002 Griffiths ..... B63C 11/04 2/2.15
2007/0000014 A1 * 1/2007 Rotella ..... A41D 19/0089 2/114
2007/0012397 A1 * 1/2007 de Jong ..... A62B 17/005 156/252
2007/0067886 A1 * 3/2007 Hunter ..... B63C 9/087 2/2.16
2008/0092280 A1 * 4/2008 Johnson ..... A41D 13/0005 2/455
2009/0210987 A1 * 8/2009 Demetropoulos ..... B63C 11/04 2/2.15
2009/0320177 A1 * 12/2009 Lin ..... A41B 7/00 2/114
2010/0005576 A1 * 1/2010 Andrews ..... A41D 13/012 2/468
2011/0000003 A1 * 1/2011 Shiue ..... B63C 11/04 2/2.15
2011/0173732 A1 * 7/2011 Gordon ..... A41D 13/012 2/2.16
2012/0023631 A1 * 2/2012 Fischer ..... A41D 13/012 2/2.15
2013/0247267 A1 * 9/2013 Luomala ..... A41D 13/0005 2/2.17
2014/0033389 A1 * 2/2014 Falken ..... B63C 11/04 2/2.15
2015/0197324 A1 * 7/2015 Marlin ..... B63C 11/04 2/2.16

* cited by examiner

SEALING SLEEVE FOR WATERPROOF GARMENTS

CROSS-REFERENCE TO RELATED APPLICATIONS

This application claims priority to Australian Provisional Patent Application No. 2016901480, filed Apr. 21, 2016, the contents of which are hereby incorporated by reference in their entirety.

TECHNICAL FIELD

The present disclosure generally relates to sealing sleeves, and more particularly relates to sealing sleeves suitable for use in waterproof garments (e.g., dry suits, survival suits, smocks, jackets, etc.) used for aquatic sports (e.g., surfing, sailing, paddling, swimming, diving, scuba diving, etc.) and other aquatic activities (collectively, "aquatic activities").

BACKGROUND

There are many types of waterproof garments used in aquatic activities. An example is a waterproof sailing suit known as a dry suit. The sailor can wear thermal garments underneath the dry suit for warmth and comfort, and the dry suit features water-tight sealing sleeves (sometimes referred to simply as "seals" or "sleeves") at the neck, wrist, and other openings to prevent the ingress of water. Full-body dry suits generally have a large waterproof zipper to allow for donning and doffing of the dry suit. Other waterproof garments commonly used in aquatic activities include smocks and jackets, which can also feature water-tight sealing sleeves at the neck and/or wrist to prevent the ingress of water.

The waterproof garments are commonly made from a waterproof laminated or coated textile joined by stitching and/or gluing. The seams are commonly made water-tight by the application of hot-melt adhesive tape. The textiles used to construct these waterproof garments generally have limited stretch and therefore are not capable of forming a water-tight seal around the body at openings in areas such as the wrists, neck, ankles, or other areas. It is commonly known in the art to provide water-tight sealing sleeves made from an elastomeric rubber material formed into a tubular cuff, with a narrower opening sealing around the wearer's body and a larger opening joined to the opening of the waterproof garment.

Water-tight sealing sleeves known in the art are made of an elastomeric rubber material that provides adequate elongation so that the sealing sleeve can be stretched over the head, hands, and/or ankles when donning and doffing the waterproof garment, and so that the sealing sleeve can fit securely around the neck, wrist, and/or ankle once in place to provide a substantially water-tight seal.

Known sealing sleeves are generally manufactured by a dipping process, whereby a form is dipped into a liquid rubber and allowed to set. The rubber material used in these sealing sleeves degrade over time due to exposure to ultraviolet light from the sun and/or ozone from pollution, and therefore need to be frequently replaced. While some products also provide a neoprene or other synthetic rubber material coating on the outer face of the sealing sleeve to provide improved protection from the degradation, it is still common for the sealing sleeve to degrade during the normal working life of the waterproof garment.

Another common issue with known rubber sealing sleeves is the poor tearing strength of the rubber, which causes the sealing sleeves to be easily damaged during use. Any minor scratch or puncture in the rubber creates a stress point in the material, and commonly leads to the propagation of a tear when the sealing sleeves are stretched. In cases where a user needs to cut the rubber sealing sleeve to increase its size, it is also common that the trimming process leaves the sealing sleeve even more susceptible to tearing due to increased stress points created by imperfect trimming. Importantly, it is common that when a rubber sealing sleeve is damaged due to tearing, it is not easily repairable as the tear propagates across the entire length and/or width of the rubber sealing sleeve.

Known rubber sealing sleeves are generally attached to a garment textile using a solvent-based adhesive. This is difficult to apply at a mass-production level, and makes the rubber sealing sleeves difficult to replace. U.S. Pat. No. 6,576,337 to Radford-Hancock discloses a rubber sealing sleeve having an additional surface coating of a thermoplastic polymer that allows the rubber sealing sleeve to be bonded with the waterproof garment textile via a hot-melt tape, thereby providing an easier method of attachment on a regular production line of waterproof garments.

It is also known in the art to provide sealing sleeves that include a neoprene foam and textile composite. While known neoprene sealing sleeves provide improved tearing resistance compared to known rubber sealing sleeves, they do not provide sufficient waterproofness for many applications, as they do not provide a sufficiently tight fit around the user's neck or wrist. Neoprene sealing sleeves also have a substantially greater thickness than conventional rubber sealing sleeves, making them bulky and too warm for aquatic activities. The use of neoprene can also cause irritation issues with many users.

In addition, neoprene sealing sleeves present similar difficulties to rubber sealing sleeves in mass-production, as they are generally attached to garments using a solvent-based adhesive, which is a time-consuming process.

Aspects of the present invention are directed at overcoming the above-described problems and providing an improved sealing sleeve for use in waterproof garments. Aspects of the present invention relate to an improved sealing sleeve that provides an adequate water-tight seal around the wearer's body, with improved durability and reparability, and that is easy to join to waterproof garments using common manufacturing techniques known in the art.

SUMMARY

According to an aspect of the present invention, a waterproof garment is provided that includes a waterproof garment textile defining a garment opening, and a sealing sleeve joined at the garment opening. The sealing sleeve includes a substantially waterproof textile composite in the form of a tube extending between (i) a first end having a first opening and configured to fit tightly around a wearer's body part and (ii) an opposing second end having a second opening and joined to the waterproof garment textile by a seam around the garment opening. The textile composite includes a stretchable textile with a substantially waterproof coating layer applied to the stretchable textile.

According to another aspect of the present invention, a sealing sleeve is provided for use in a waterproof garment. The sealing sleeve includes a substantially waterproof textile composite in the form of a tube extending between (i) a first end having a first opening and configured to fit tightly around a wearer's body part and (ii) an opposing second end having a second opening and configured to be joined to a waterproof garment textile by a seam around a garment opening. The textile composite includes a stretchable textile with a substantially waterproof coating layer applied to the stretchable textile.

In addition to, or as an alternative to, one or more of the features described above, further aspects of the present invention can include one or more of the following features, individually or in combination:

- the garment opening is at least one of a neck opening sized to be larger than a wearer's head, and the sealing sleeve is a neck sealing sleeve configured to provide a substantially water-tight seal around a wearer's neck;
- the garment opening is a wrist opening sized to be larger than a wearer's wrist, and the sealing sleeve is a wrist sealing sleeve configured to provide a substantially water-tight seal around the wearer's wrist;
- the garment opening is an ankle opening sized to be larger than a wearer's ankle, and the sealing sleeve is an ankle sealing sleeve configured to provide a substantially water-tight seal around the wearer's ankle;
- the stretchable textile is a woven, knitted, and/or non-woven textile, and the stretchable textile includes at least one of nylon yarns, polyester yarns, polypropylene yarns, and elastane yarns;
- the coating layer is positioned on an inside face of the textile composite for directly contacting the wearer's body part, and the coating layer defines a surface that is smooth to provide a substantially water-tight seal between the textile composite and the wearer's body part;
- the coating layer includes a substantially water impermeable polyurethane film that includes at least one of polyether-polyurethane, polyester-polyurethane, polycarbonate-polyurethane, and composites thereof;
- the polyurethane film is moisture vapor permeable to allow perspiration moisture built up within the garment to escape through the textile composite;
- the polyurethane film has a thickness of between 0.01 mm and 0.1 mm.
- the polyurethane film has a thickness of between 0.1 mm and 0.5 mm, and includes a foamed polyurethane;
- an elastomeric reinforcement material applied to the stretchable textile and/or the coating layer of the textile composite around the first opening of the sealing sleeve;
- the elastomeric reinforcement material has a higher elastic modulus and/or a higher stretch modulus than the textile composite;
- the elastomeric reinforcement material is configured in two or more bands;
- the elastomeric reinforcement material is applied to the textile composite to prevent fraying of the textile composite around an edge of the first opening of the sealing sleeve;
- the elastomeric reinforcement material is an elastomeric polyurethane film with a thickness between 40 μm and 300 μm;
- the elastomeric polyurethane film includes a hot-melt adhesive on one side that is used to bond the elastomeric polyurethane film to the textile composite;
- the elastomeric reinforcement material is positioned on an inside of the sealing sleeve;
- the elastomeric reinforcement material is positioned on an outside of the sealing sleeve in rings parallel to the first opening for use as a guide for a user to trim the sealing sleeve to a required size;
- the elastomeric reinforcement material is positioned along a length of the sealing sleeve in a predetermined stripe pattern that reduces stretch along the length of the sealing sleeve whilst maintaining adequate elongation around an opening circumference of the seam;
- the elastomeric reinforcement material is a first elastomeric reinforcement material and is provided around the first opening of the sealing sleeve, and the waterproof garment further includes a second elastomeric reinforcement material around the second opening of the sealing sleeve;
- the second elastomeric reinforcement material has higher elastic modulus and/or a lower elongation than the textile composite;
- the second elastomeric reinforcement material is provided on an outside of the sealing sleeve around the first opening to provide increased modulus and/or to prevent fraying of the textile;
- the sealing sleeve includes first and second panels of the textile composite formed at seams;
- a hot-melt waterproof seam sealing tape joins the first and second panels of the textile composite at the seams;
- the hot-melt seam sealing tape is applied to the coating layer of the textile composite;
- the hot-melt seam sealing tape is applied to both sides of the textile composite;
- the textile composite is joined to garment textile by stitching;
- the sealing sleeve is configured to be trimmed by a user to increase a circumference of the first opening and thereby allow for a relatively looser fit around the wearer's body part;
- the coating layer is a polyurethane material and is configured to bond to a hot-melt waterproof seam sealing tape;
- the seams are ultrasonically welded and reinforced with a hot-melt waterproof seam sealing tape to produce a flat seam, thereby allowing improved sealing around the first opening of the sealing sleeve;
- the waterproof garment textile is less stretchable than the sealing sleeve;
- the textile composite is stretchable to at least 100% elongation around the garment opening before tensile failure;
- the textile composite is stretchable to greater than 300% elongation around the garment opening before tensile failure;
- stretchability of the textile composite along a length of the sealing sleeve is less than 200% before tensile failure;
- stretchability of the textile composite along the length of the sealing sleeve is less than 100% before tensile failure;

These and other aspects of the present invention will become apparent in light of the drawings and detailed description provided below.

DETAILED DESCRIPTION

The present disclosure describes water-tight sealing sleeves suitable for use in the neck, wrist, ankle, and/or other openings of waterproof garments, as well as waterproof garments including such sealing sleeves.

Figure 1:
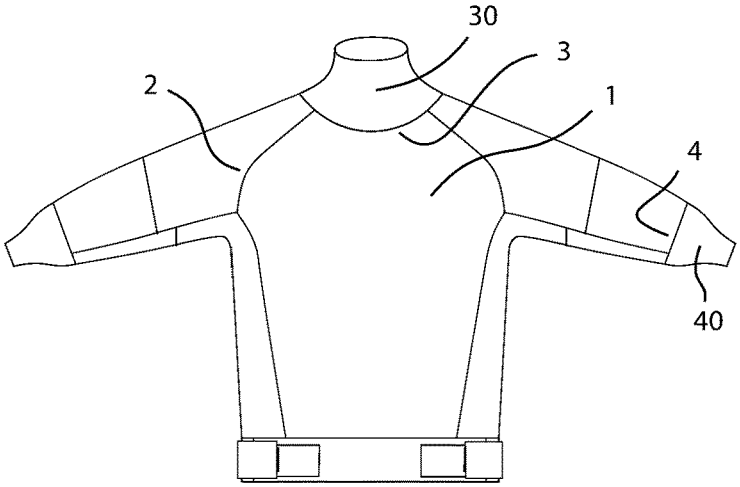
FIG. 1 is a front view of a waterproof smock with sealing sleeves at the neck and wrist openings.
Figure 2:
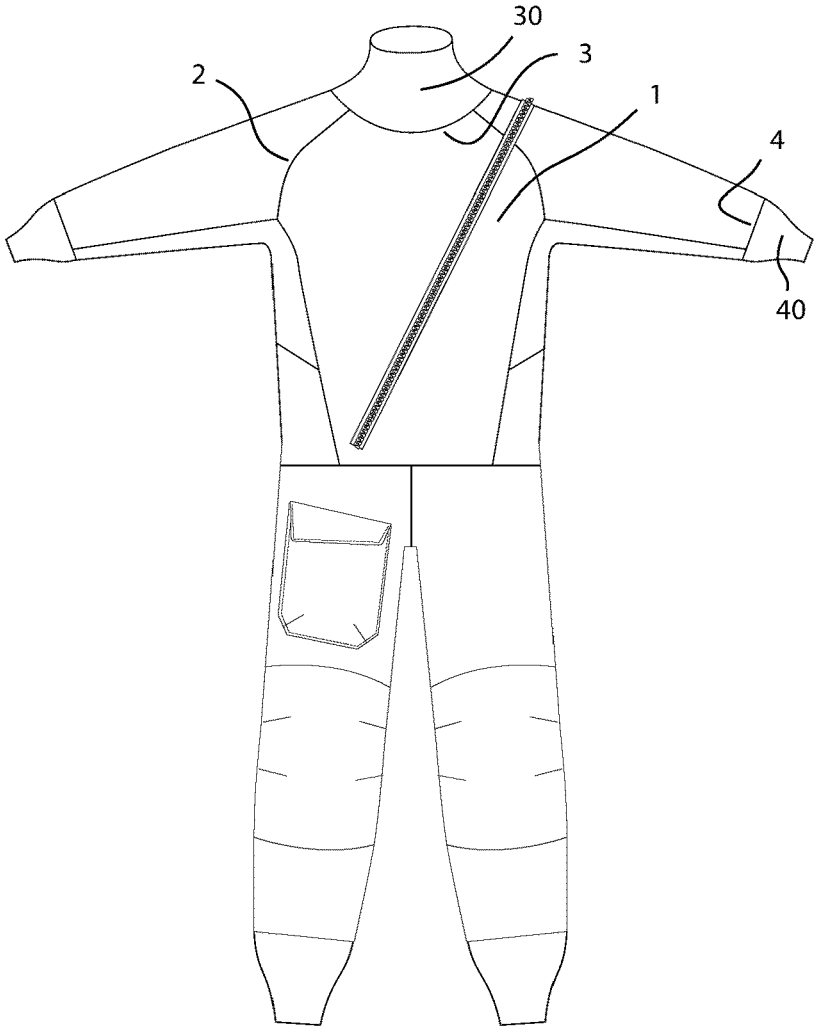
FIG. 2 is a front view of a waterproof drysuit with sealing sleeves at the neck, wrist, and ankle openings.

Examples of waterproof garments including the sealing sleeves 30, 40 are shown in FIGS. 1 and 2. FIG. 1 shows a waterproof smock intended for sailing. FIG. 2 shows a waterproof dry suit commonly used for sailing as well as many other aquatic activities. The waterproof garments are generally made from a waterproof textile 1 joined at seams 2 by a waterproof hot-melt adhesive seam tape or other method known in the art. The waterproof garments feature a neck sealing sleeve 30 joined to a neck opening 3 to provide a water-tight seal around the wearer's neck, and wrist sealing sleeves 40 joined to wrist openings 4 to form water-tight seals around the wearer's wrists.

The waterproof textile 1 generally has limited stretch. The neck opening 3 is generally sized to be larger than the wearer's head, allowing the head to fit through the neck opening 3. The wrist opening 4 is generally sized to be larger than the wearer's hand, allowing the hand to fit through the wrist opening 3. The neck sealing sleeve 30 and the wrist sealing sleeves 40 are each provided in a tubular shape. The neck sealing sleeve 30 and wrist sealing sleeves 40 have respective first openings 31, 41 (see FIGS. 3-6A and 8-9) sized to fit tightly around the wearer's neck and wrist, respectively, to form water-tight seals. The sealing sleeves 30, 40 are provided to be stretchable around the respective first openings 31, 41 so that the sealing sleeves 30, 40 can be pulled over the wearer's head and hands, respectively, when donning and doffing.

Figure 3:
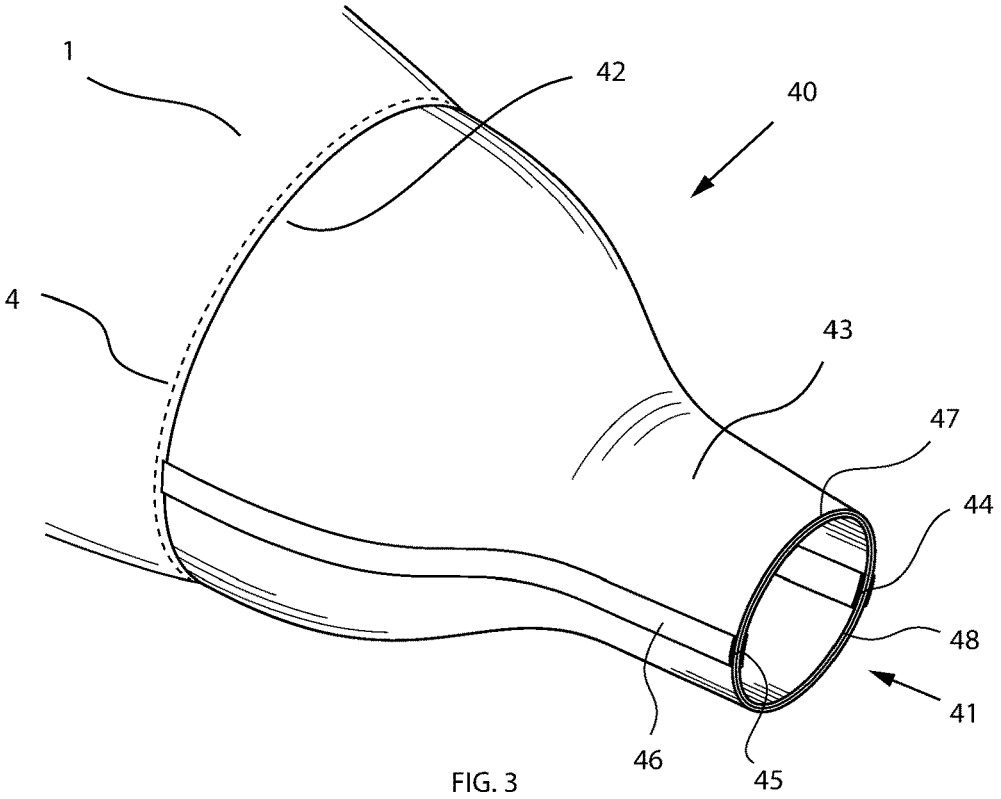
FIG. 3 is an oblique view of a wrist sealing sleeve.

FIG. 3 shows an embodiment in which a wrist sealing sleeve 40 is constructed from a flexible tube that includes a substantially waterproof textile composite 43 with a first opening 41 configured to fit tightly around the wearer's wrist and a second opening 42 which is configured to be joined by a seam around wrist opening 4 of a waterproof garment. The first opening 41 is configured to fit tightly around the wearer's wrist to provide a substantially water-tight seal between the skin and the textile composite 43. The textile composite 43 is stretchable at least around the circumference of the first opening 41 to allow the wrist sealing sleeve 40 to be stretched over the wearer's hand when donning and doffing the waterproof garment.

In some embodiments, the textile composite 43 is stretchable to allow at least 100% elongation around the wrist opening 4 before tensile failure. In some embodiments, the textile composite 43 is stretchable to allow an elongation greater than 300% around the wrist opening 4 before tensile failure. In some embodiments, the textile composite 43 is also stretchable along the length of the wrist sealing sleeve 40, between the first opening 41 and second opening 42, to allow improved movement of the wearers body. In some embodiments, the stretchability of the textile composite 43 along the length of the wrist sealing sleeve 40 is limited to 200% before tensile failure to allow for easier donning and doffing of the wrist sealing sleeve 40. In some embodiments, the stretchability of the textile composite 43 along the length of the wrist sealing sleeve 40 is limited to less than 100% before tensile failure to allow for easier donning and doffing of the wrist sealing sleeve 40. The reduced stretchability along the length relative to the circumference of the openings 41, 42 allows the tight-fitting wrist sealing sleeve 40 to be more easily pulled over the wearer's hand without overstretching the wrist sealing sleeve 40.

The respective circumferences of the second opening 42 and the wrist opening 4 of the waterproof garment are configured to allow the hand to pass through the wrist opening 4 when donning and doffing the waterproof garment. If the textile 1 of the waterproof garment has minimal stretch, then the circumference of the wrist opening 4 should be larger than the largest circumference of the wearer's hand.

In some embodiments, the substantially waterproof textile composite 43 includes a stretchable woven, knitted, or non-woven textile with at least one waterproof coating layer 48 applied to one or both sides of the textile. The textile composite 43 provides significantly improved resistance to tearing compared to the rubber sealing sleeves commonly used in the art. In the embodiment shown in FIG. 3, for example, the textile composite 43 includes a stretchable textile 47 combined with a waterproof coating layer 48, whereby the waterproof coating layer 48 is positioned on the inside face of the textile composite 43 so that it directly contacts the wearer's body. In some embodiments, the waterproof coating layer 48 has an outer surface that is smooth to provide a good water-tight seal between the textile composite 43 and the skin.

In some embodiments, the stretchable textile 47 is a stretchable knitted, woven, or non-woven textile that includes synthetic yarns (e.g., nylon, polyester, polypropylene, and/or stretchable elastane yarns) and/or natural yarns. In some embodiments, the stretchable textile 47 is configured to provide at least 100% elongation around the circumference of the first opening 41 of the wrist sealing sleeve 40 before tensile failure. In some embodiments, the stretchable textile 47 is configured to allow an elongation greater than 300% around the first opening 41 of the wrist sealing sleeve 40 before tensile failure. In some embodiments, the stretchable textile 47 is configured to provide stretchability along the length of the wrist sealing sleeve 40 between the first opening 41 and the second opening 42 to allow improved movement of the wearer's body. In some embodiments, stretchability of the stretchable textile 47 is configured to limit elongation along the length of the wrist sealing sleeve 40 to around 200% before tensile failure to allow for easier donning and doffing of the wrist sealing sleeve 40. In some embodiments, stretchability of the stretchable textile 47 is configured to limit elongation along the length of the wrist sealing sleeve 40 to less than 100% before tensile failure to allow for easier donning and doffing of the wrist sealing sleeve 40.

In some embodiments, the substantially waterproof coating layer 48 is made of a substantially water impermeable polyurethane film lamination that provides adequate stretch modulus and recovery to fit tightly around the wearer's body to provide a water-tight seal. The polyurethane film can be made of materials such as polyether-polyurethane, polyester-polyurethane, polycarbonate-polyurethane, and composites thereof. In some embodiments, the coating layer 48 includes a polyurethane coating or composite coating and film lamination. In some embodiments, the polyurethane coating or film lamination is moisture vapor permeable to allow moisture built up within the waterproof garment from perspiration to escape through the textile composite 43. In some embodiments, the polyurethane film has a thickness of between 0.01 mm and 0.1 mm. In some embodiments, the polyurethane film has a thickness of between 0.1 mm and 0.5 mm, and includes a foamed polyurethane that allows greater elongation of the textile composite 43.

In some embodiments, the waterproof coating layer 48 is selected from a polyurethane material that can bond to a hot-melt waterproof seam sealing tape or adhesive film commonly used in the art to form a water-tight seal between the second opening 42 of the wrist sealing sleeve 40 and the wrist opening 4 of the waterproof garment 1. The ability to bond with hot-melt seam sealing tapes allows for easy mass production of the waterproof garments using conventional sealing techniques known in the art. It also allows for ease of replacement or repair of damaged sealing sleeves by the application of hot-melt adhesive seam tape or patches.

In the embodiment shown in FIG. 3, the tubular shape of the sealing sleeve 40 is formed by joining two panels of the waterproof textile composite 43 at seams 44, 45. The seams 44, 45 are constructed to be substantially water-tight. In some embodiments, the seams 44, 45 are constructed by sewing and seam taping using a substantially waterproof hot-melt seam sealing tape 46. In some embodiments, the seams 44, 45 are ultrasonically welded and then reinforced with the seam sealing tape 46 to produce flat seam thereby allowing improved sealing around the first opening 41 of the wrist sealing sleeve 40. The seam sealing tape 46 is applied to the substantially waterproof coating layer 48 of the textile composite 43 to provide a good waterproof seal. In the embodiment of FIG. 3, the seam sealing tape 46 is applied to both sides of the textile composite 43 to provide additional reinforcement to the seam. In other embodiments, the wrist sealing sleeve 40 is formed from at least one flat panel of the textile composite 43 that is joined by at least one seam thereby forming the tube. In other embodiments, the tubular shape of the wrist sealing sleeve 40 is formed by constructing the textile composite 43 into a tubular shape and coating or laminating the waterproof coating layer 48 onto the textile composite 43 thereby eliminating the need for additional seams to create the desired shape.

In some embodiments, the wrist sealing sleeve 40 can be trimmed by the user around the circumference of the first opening 41 to thereby increase the circumference of the first opening 41 to allow for a looser fit around the body.

Figure 4:
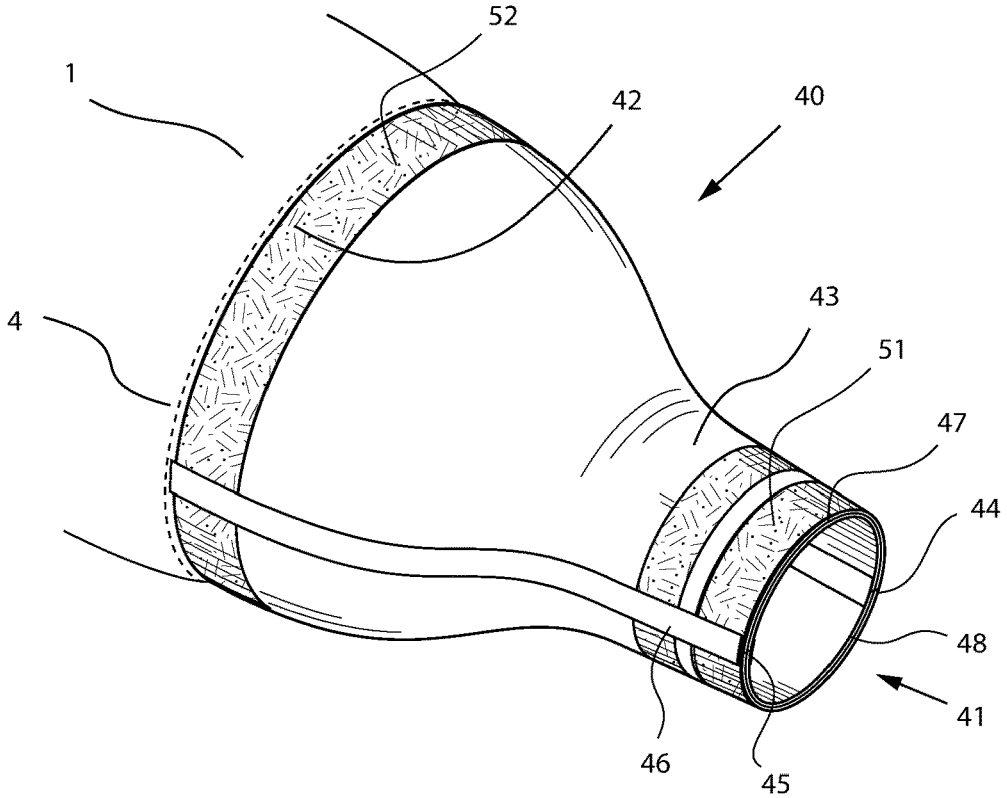
FIG. 4 is an oblique view of a wrist sealing sleeve.
Figure 5:
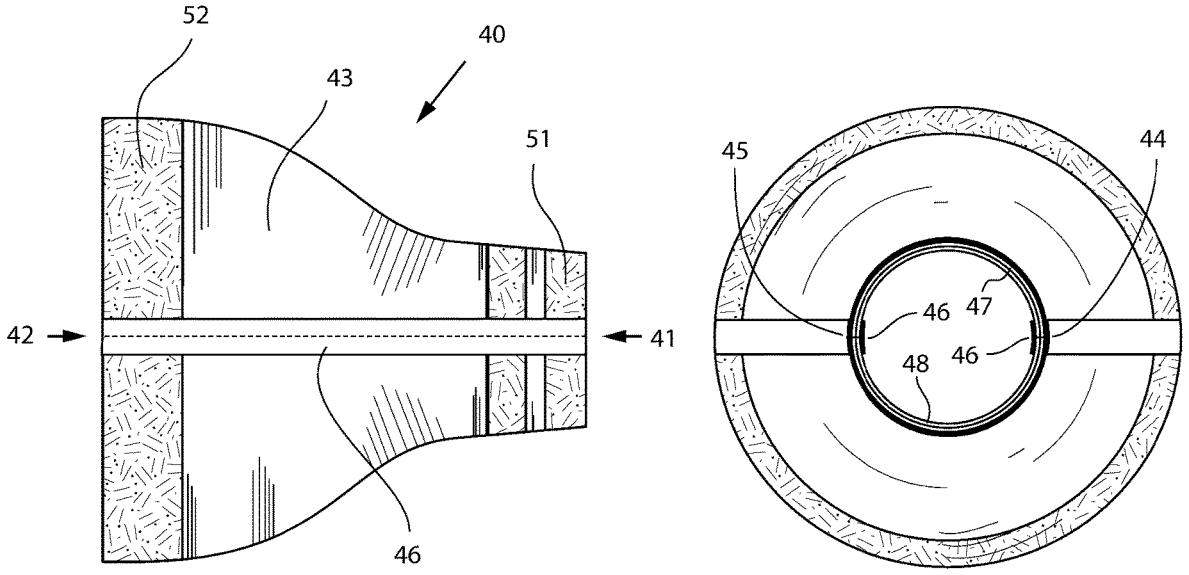
FIG. 5 is a front and side view of the wrist sealing sleeve of FIG. 4.

Referring to FIG. 4, a water-tight wrist sealing sleeve 40 is provided featuring an elastomeric reinforcement material 51 that is combined with the textile composite 43 around the first opening 41 of the wrist sealing sleeve 40. In some embodiments, the elastomeric reinforcement material 51 is configured to have a similar or higher elastic modulus than the waterproof textile composite 43 to provide improved stretch recovery after repeated donning and doffing. In some embodiments, the elastomeric reinforcement material 51 is configured to have a higher stretch modulus than the textile composite 43 to provide a firmer fit around the body, thereby improving the water-tight seal. In some embodiments, the elastomeric reinforcement material 51 is configured in two or more bands to improve comfort to the wearer. The elastomeric reinforcement material 51 is applied to the waterproof coating layer 48 and/or textile layer 47 of the textile composite 43. In some embodiments, the reinforcement material 51 is applied to the textile side 47 of the textile composite 43 to prevent fraying of the textile composite 43 around the edge of the first opening of the seal. In some embodiments in which the sealing sleeve is configured to be trimmed by the user, the reinforcement material is also configured to reinforce the cut area to prevent tearing or fraying from the cut edge.

In some embodiments, the elastomeric reinforcement material 51 includes a knitted or woven textile, polymeric film or coating or fabric and film composite applied the to the textile composite 43 by laminating, bonding, printing, stitching, gluing or other process. In some embodiments, the reinforcement is an elastomeric polyurethane film with a thickness between 40 μm and 300 μm comprising a hot-melt adhesive on one side that is used to bond the film to the textile composite 43.

In some embodiments, a second elastomeric reinforcement material 52 is combined with the textile composite 43 around the second opening 42 of the sealing sleeve 40 where the seam is joined to garment textile 1. The second reinforcement material 52 is provided for embodiments where the waterproof textile composite 43 is stretchable along the length of the sealing sleeve between the first opening 41 and second opening 42. The second reinforcement material 52 is configured to have a higher elastic modulus and/or lower elongation than the waterproof textile composite 43 to reduce the stretch in the area where the stretchable sealing sleeve 40 is joined to the waterproof garment textile 1 thereby providing a gradual reduction in stretch between the sealing sleeve and the non-stretch textile reducing stress at the seam and increasing the durability of the sealing sleeve attachment.

Figure 7:
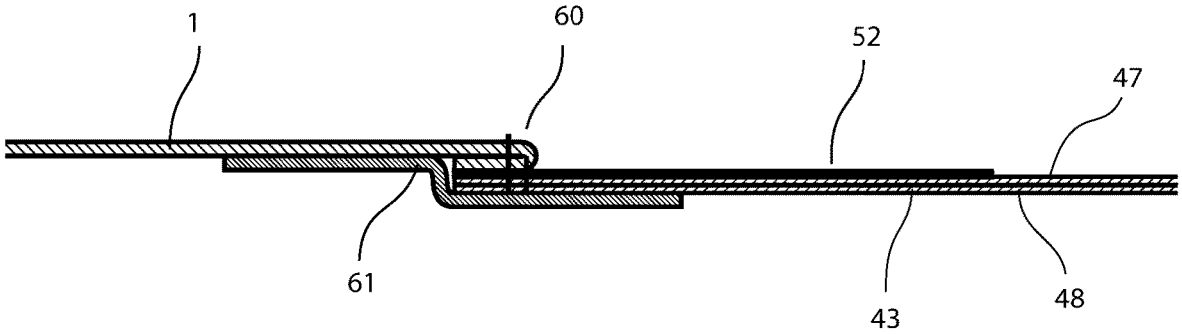
FIG. 7 is a cross-sectional detail view of the wrist sealing sleeve of FIG. 4.

FIG. 7 shows a cross-section detail view of the seam joining garment textile 1 at opening 4 to seal waterproof textile composite 43 at the second opening 42. The waterproof textile composite 43 features the second elastomeric reinforcement material 52 applied to textile layer 47. The waterproof textile composite 43 is joined to garment textile 1 by stitching 60, and the seam is made waterproof by the application of a substantially waterproof seam sealing tape 61 that bonds to garment textile 1 and the waterproof coating layer 48 of the waterproof textile composite 43. The second elastomeric reinforcement material 52 reduces the stretch of the textile composite 43 at the join to textile 1 thereby reducing the stress of the textile composite 43 at the join when the sealing sleeve is stretched.

The second elastomeric reinforcement material 52 includes a knitted or woven textile, polymeric film or coating or fabric and film composite applied the to the textile composite 43 by laminating, bonding, printing, stitching, gluing or other process. In some embodiments, the reinforcement is an elastomeric polyurethane film with a thickness between 40 μm and 300 μm comprising a hot-melt adhesive on one side that is used to bond the film to the textile composite 43.

Figure 6:
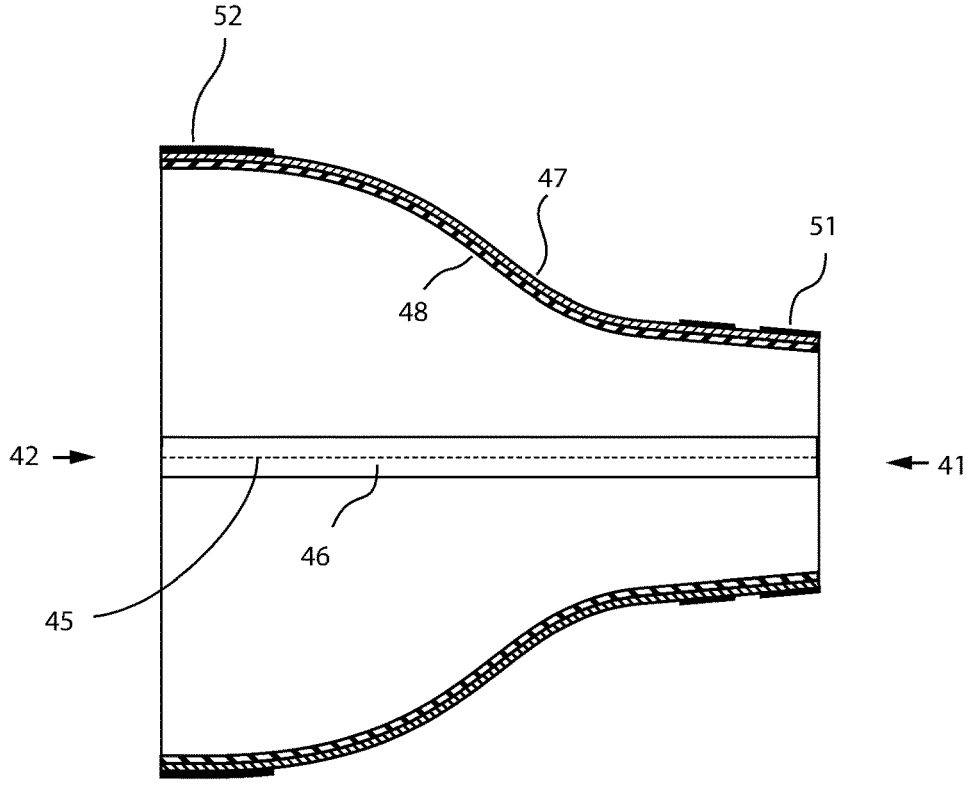
FIG. 6 is a cross-sectional side view of the wrist sealing sleeve of FIG. 4.

Referring to FIGS. 4 and 6, sealing sleeve 40 with first opening 41 and second opening 42 is constructed from waterproof textile composite 43 that includes inner waterproof coating layer 48 and outer textile layer 47. The textile composite 43 is joined at seams 45 and sealed with seam sealing tape 46. Elastomeric reinforcement material 51 is provided around first opening 41, a second elastomeric reinforcement material 52 is provided around second opening 42.

Figure 6A:
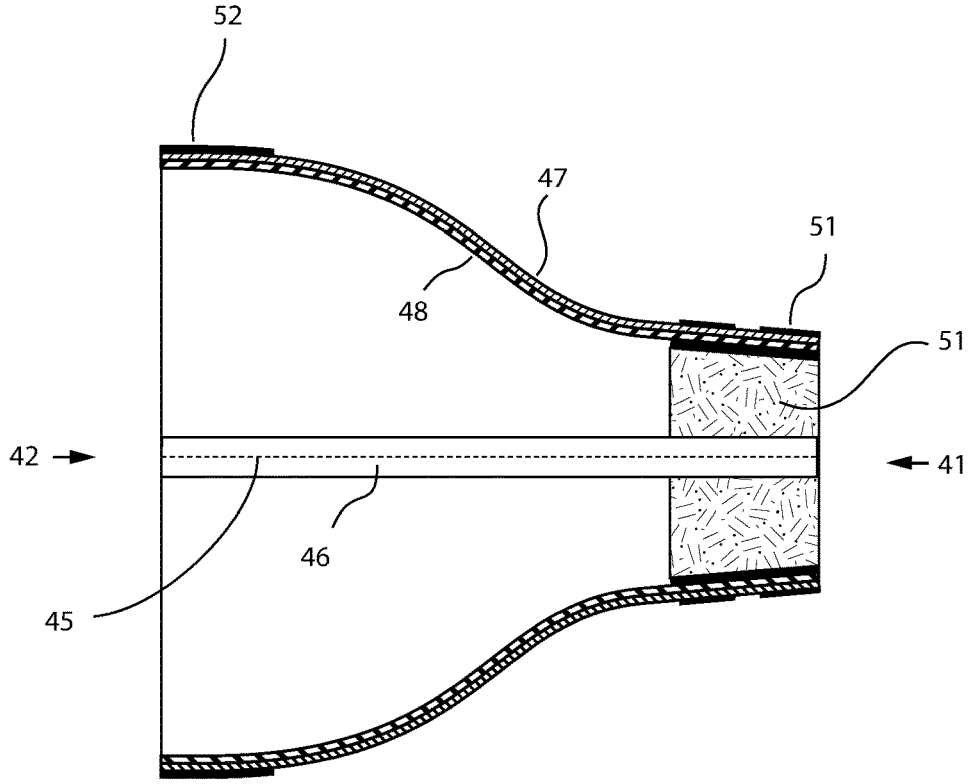
FIG. 6A is a cross-sectional side view of a wrist sealing sleeve.

Another embodiment is shown in FIG. 6A whereby elastomeric reinforcement material 51 is provided around first opening 41 on the inside of the sealing sleeve 40. The elastomeric reinforcement material is positioned on the inside of the sealing sleeve to provide a tighter fit against the skin. Additional reinforcement material 51 can be provided on the outside of the sealing sleeve around the first opening 41 to provide increased modulus to provide an even further fit and/or to prevent fraying of the stretchable textile 47. The reinforcement material 51 on the outside of the sealing sleeve can also be disposed on the sealing sleeve in rings parallel to the first opening 41 that can be used as a guide for the user to trim the sealing sleeve to a required size.

Figure 9:
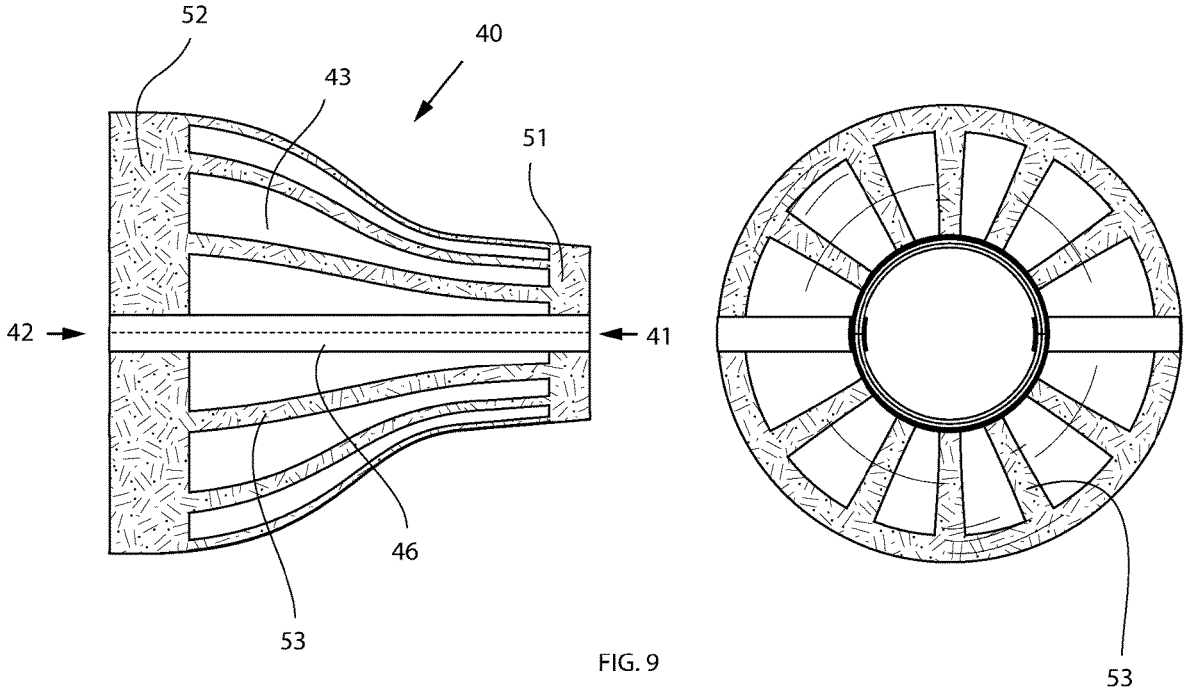
FIG. 9 is a front and side view of a wrist sealing sleeve.

In the embodiment of FIG. 9, an additional elastomeric reinforcement material 53 is applied to the sealing sleeve 40 in the form of stripes along the length of the sealing sleeve 40 that reduces stretch along the length of the sealing sleeve 40 whilst maintaining adequate elongation around the opening circumference of the seam to allow for easier donning and doffing of the sealing sleeve 40. In some embodiments, the stripes of the additional elastomeric reinforcement material 53 can form a predetermined regular or irregular pattern.

Figure 8:
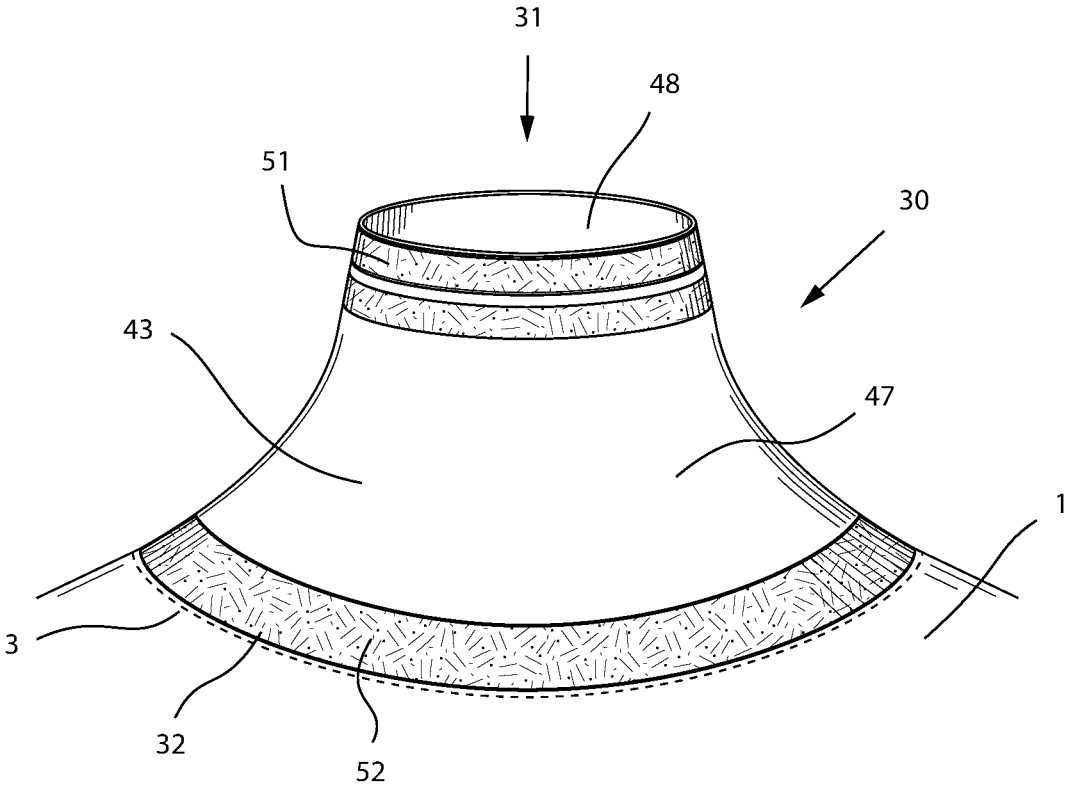
FIG. 8 is an oblique view of a neck sealing sleeve.

FIG. 8 shows another embodiment whereby a water-tight neck sealing sleeve 30 is provided constructed from a flexible tube that includes a substantially waterproof textile composite 43 with a first opening 31 configured to fit tightly around the wearer's neck and a second opening 32 which is configured to be joined by a seam around neck opening 3 of a waterproof garment. The first opening 31 is configured to fit tightly around the wearer's neck to provide a substantially water-tight seal between the skin and textile composite 43, the textile composite 43 is stretchable at least around the circumference of the first opening to allow the sealing sleeve to be stretched over the wearer's head when donning and doffing the waterproof garment. The neck sealing sleeve 30 and any ankle sealing sleeves can be configured in a same or similar manner to the wrist sealing sleeves 40, but can be sized differently so as to form water-tight seals at the neck and ankles, respectively.

The present disclosure describes aspects of the present invention with reference to the exemplary embodiments illustrated in the drawings; however, aspects of the present invention are not limited to the exemplary embodiments illustrated in the drawings. It will be apparent to those of ordinary skill in the art that aspects of the present invention include many more embodiments. Accordingly, aspects of the present invention are not to be restricted in light of the exemplary embodiments illustrated in the drawings. It will also be apparent to those of ordinary skill in the art that variations and modifications can be made without departing from the true scope of the present disclosure. For example, in some instances, one or more features disclosed in connection with one embodiment can be used alone or in combination with one or more features of one or more other embodiments.

What is claimed is:

1. A waterproof garment, comprising:

a waterproof garment textile defining a garment opening;

a sealing sleeve joined at the garment opening, the sealing sleeve including a waterproof textile composite in the form of a tube extending between (i) a first end having a first opening and configured to fit tightly around a wearer's body part and (ii) an opposing second end having a second opening and joined to the waterproof garment textile by a seam around the garment opening;

wherein the textile composite includes a stretchable textile with a waterproof coating layer applied to the stretchable textile;

wherein the waterproof layer includes a water impermeable polyurethane film that includes at least one of polyether-polyurethane, polyester-polyurethane, and polycarbonate-polyurethane; and wherein the textile composite has an inside face and an outside face, in which the waterproof layer is on said inside face configured to contact the wearer, and the stretchable textile is on said outside face.

2. The waterproof garment of claim 1, wherein the garment opening is at least one of a neck opening sized to be larger than a wearer's head, and the sealing sleeve is a neck sealing sleeve configured to provide a watertight seal around a wearer's neck.

3. The waterproof garment of claim 1, wherein the stretchable textile is a woven, knitted, and/or non-woven textile, and wherein the stretchable textile includes at least one of nylon yarns, polyester yarns, polypropylene yarns, and elastane yarns.

4. The waterproof garment of claim 1, wherein the waterproof layer defines a surface that is smooth and is adapted to provide a water-tight seal between the textile composite and the wearer's body part.

5. The waterproof garment of claim 1, wherein the polyurethane film is moisture vapor permeable to allow perspiration moisture built up within the garment to escape through the textile composite.

6. The waterproof garment of claim 1, wherein the polyurethane film has a thickness of between 0.1 mm and 0.5 mm, and includes a foamed polyurethane.

7. The waterproof garment of claim 1, further comprising an elastomeric reinforcement material applied to the stretchable textile and/or the coating layer of the textile composite around the first opening of the sealing sleeve.

8. The waterproof garment of claim 7, wherein the elastomeric reinforcement material has a higher elastic modulus and/or a higher stretch modulus than the textile composite.

9. The waterproof garment of claim 7, wherein the elastomeric reinforcement material is configured in two or more bands.

10. The waterproof garment of claim 7, wherein the elastomeric reinforcement material is applied to the textile composite to prevent fraying of the textile composite around an edge of the first opening of the sealing sleeve.

11. The waterproof garment of claim 7, wherein the elastomeric reinforcement material is an elastomeric polyurethane film with a thickness between 40 pm and 300 pm.

12. The waterproof garment of claim 11, wherein the elastomeric polyurethane film includes a hot-melt adhesive on one side that is used to bond the elastomeric polyurethane film to the textile composite.

13. The waterproof garment of claim 7, wherein the elastomeric reinforcement material is positioned on an outside of the sealing sleeve in rings parallel to the first opening configured for use as a guide for a user to trim the sealing sleeve to a required size.

14. The waterproof garment of claim 7, wherein the elastomeric reinforcement material is a first elastomeric reinforcement material and is provided around the first opening of the sealing sleeve, and wherein the waterproof garment further comprises a second elastomeric reinforcement material around the second opening of the sealing sleeve.

15. The waterproof garment of claim 14, wherein the second elastomeric reinforcement material has higher elastic modulus and/or a lower elongation than the textile composite.

16. The waterproof garment of claim 14, wherein the second elastomeric reinforcement material is provided on an outside of the sealing sleeve around the first opening to provide increased modulus and/or to prevent fraying of the textile.

17. The waterproof garment of claim 1, wherein the waterproof garment textile is less stretchable than the sealing sleeve.

18. The waterproof garment of claim 1, wherein the textile composite is stretchable to at least 100% elongation around the garment opening before tensile failure.

19. The waterproof garment of claim 18, wherein the textile composite is stretchable to greater than 300% elongation around the garment opening before tensile failure.

20. The waterproof garment of claim 1, wherein stretchability of the textile composite along a length of the sealing sleeve is less than 200% before tensile failure.

21. The waterproof garment of claim 20, wherein stretchability of the textile composite along the length of the sealing sleeve is less than 100% before tensile failure.

22. The waterproof garment of claim 1, wherein the waterproof layer includes a composite with at least one of polyether-polyurethane, polyester-polyurethane, and polycarbonate-polyurethane.

* * * * *